US005078386A

United States Patent [19]

Hou et al.

[11] Patent Number: 5,078,386

[45] Date of Patent: Jan. 7, 1992

[54] ORNAMENTAL CAROUSEL ASSEMBLY

[75] Inventors: Jack Hou, P.O. Box 78-5; I-Pin Feng, both of Taipei

[73] Assignee: Jack Hou, Taipei, Taiwan

[21] Appl. No.: 577,773

[22] Filed: Sep. 5, 1990

[51] Int. Cl.[5] ..... A63H 13/20

[52] U.S. Cl. ..... 272/31 R; 272/42; 74/49; 74/50

[58] Field of Search ..... 272/31 R, 31 A, 31 B, 272/31 P, 28 R, 28 S, 42, 44; 74/49, 50

[56] References Cited

U.S. PATENT DOCUMENTS 3,191,930 6/1965 Cottreu et al. ..... 272/31 R
3,897,054 7/1975 Riggs ..... 272/31 R
4,925,182 5/1990 Hou ..... 272/31 R

*Primary Examiner*—Richard E. Chilcot, Jr.
*Attorney, Agent, or Firm*—Bacon & Thomas

[57] ABSTRACT

An ornamental carousel assembly is disclosed which simulates the movements of a full-size carousel by supporting various carousel figures that both reciprocate vertically and revolve around a central vertical support column along with a canopy. The rotating and reciprocating ornaments are supported on a central support assembly by a bearing arrangement which minimizes the friction developed during movement of the ornamental elements so as to permit a miniature wind-up music box mechanism to drive the carousel. The drive assembly from the miniature wind-up music box mechanism includes a gear drive assembly for transferring drive from an output shaft of the miniature wind-up music box mechanism to rotate and reciprocate the various ornamental figures and a spring which is used to impart the necessary rotary drive force to the canopy. The inclusion of the spring serves not only to drive the canopy but also provides a safety feature wherein the canopy is permitted to flex in order to prevent damage of the canopy during transit and handling especially when heavy ceramic canopies are utilized.

21 Claims, 3 Drawing Sheets 77
78
79
130
1
101
95
48
49
51
57
52
40
76
65
65
58
54
56
75
70
46
20
27
2
3
124
123
15
125
26
120
16
113
17
4
111
92
112
109
107
106
91
98
90
82
85
80
83
10
7

ORNAMENTAL CAROUSEL ASSEMBLY

BACKGROUND OF THE INVENTION

1. Field of the Invention

The present invention generally involves the field of technology pertaining to devices for imparting different movements to a plurality of ornaments while accompanying such movements with music. More specifically, the invention relates to an improved ornamental carousel assembly wherein rotational and vertical movements are imparted to a plurality of ornaments and a canopy by a miniature wind-up music box mechanism.

2. Description of the Prior Art

It is known in the art to rotatably support an ornament on a base containing a wind-up music box mechanism. Devices of this type are often provided with plural ornaments and may even include a canopy formed from a fragile material, such as ceramic, which may be easily broken and impart considerable weight to the device. When such a device has rotating elements formed from rather heavy materials, a large amount of force must be exerted by the wind-up music box mechanism in order to perform the rotational and vertical movments desired.

Many prior art devices have overcome the inability of a miniature wind-up music box mechanism to develop the required force to rotate and reciprocate the elements of an ornamental display assembly by utilizing an electric drive motor which is driven by a power supply also housed in the base. An example of such an arrangement is represented by U.S. Pat. No. 4,753,436. Electrically driven motors, although they can more easily develop higher levels of torque output, are generally more bulky and less efficient than wind-up music box mechanisms.

SUMMARY OF THE INVENTION

It is the object of the present invention to provide an improved device for imparting movement to a plurality of ornaments supported on a base by means of a miniature wind-up music box mechanism.

It is another object of the invention to provide an improved ornamental carousel assembly wherein the rotating and reciprocating elements may be driven by a miniature wind-up music box mechanism.

It is still another object of the invention to provide an improved ornamental carousel assembly wherein rotational and vertical movements are imparted to a plurality of ornaments and rotational movement is imparted to a canopy to produce a display that captures the interest of a viewer for a long period of time.

These and other objects of the invention are realized by providing an ornamental carousel assembly wherein the rotating and reciprocating elements are rotatably supported by a bearing assembly which minimizes the friction developed during movement of the elements so as to permit a miniature wind-up music box mechanism to drive the carousel. Furthermore, a unique drive transmission assembly is provided having an elongated drive transmitting rod connected to an output shaft of the miniature wind-up music box mechanism and which transmits to a gear drive assembly in order to carry out the desired rotational and vertical movements of the various carousel elements. Also provided on the drive transmitting rod is a resilient portion which supports the carousel canopy. The resilient portion not only imparts a rotary driving force to the canopy but also permits the canopy support to flex and prevent damage to the canopy during transit and handling, especially when heavy ceramic canopies are utilized.

Other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
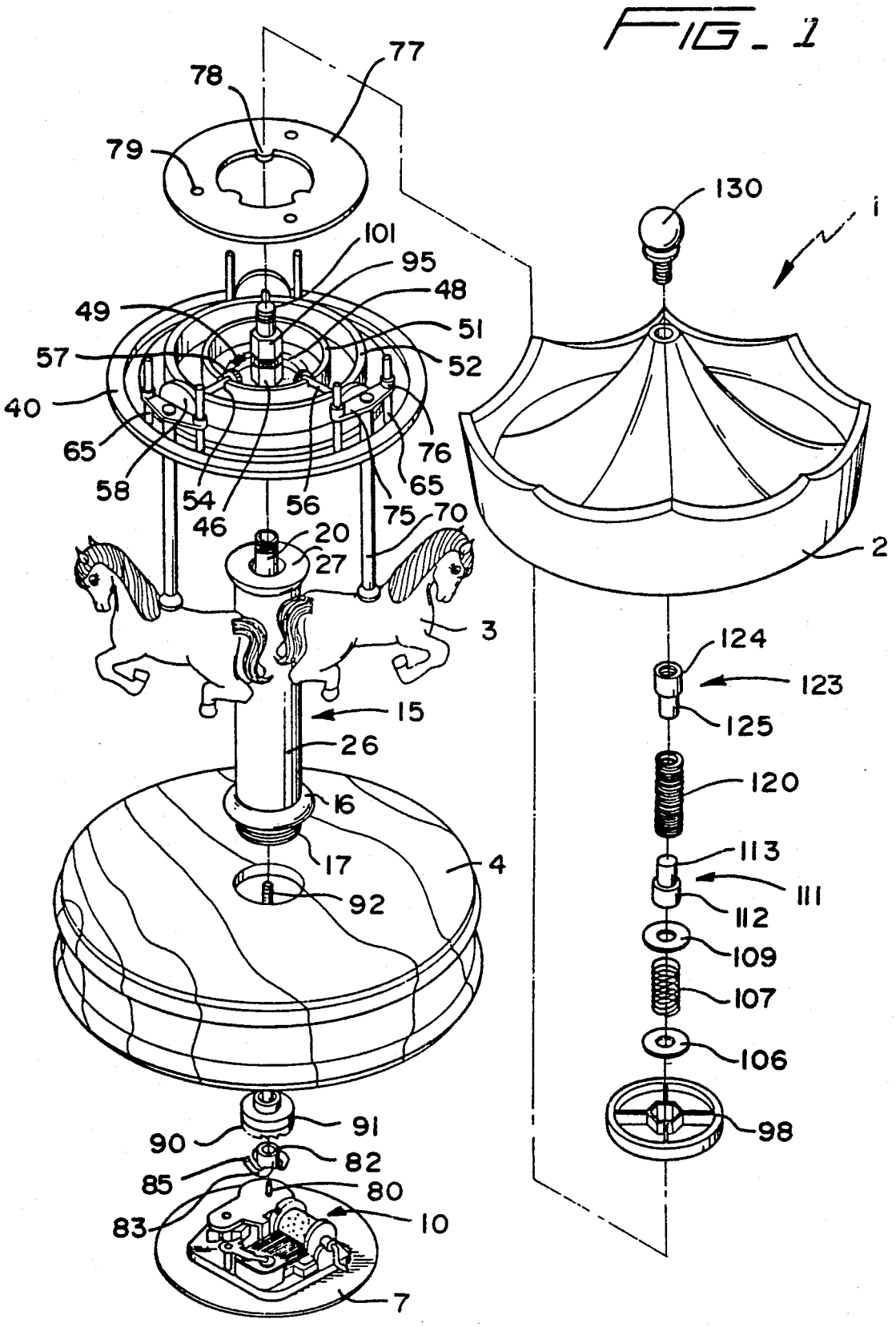
FIG. 1 is an exploded perspective view of an ornamental carousel assembly according to a preferred embodiment of the invention.

An ornamental carousel assembly 1 according to a preferred embodiment of the invention shall now be described with initial reference to FIGS. 1 and 2. As shown therein, carousel assembly 1 includes a canopy 2, and a plurality of ornaments 3, being shown in the configuration of horses, and a base stand 4. The bottom of the base stand 4 includes a plurality of rubber legs 5 for supporting the ornamental carousel assembly 1 on a horizontal surface. Located in the bottom of the base stand 4 is a box insert 6 having a base wall portion 7 to which is mounted a miniature music box 10.

Extending above the base stand 4 is an upright support assembly 15. Upright support assembly 15 includes a lower endcap 16 having threads 17 which secures the lower endcap 16 to base stand 4. Fixedly attached at its lower end to the lower end cap 16 is an elongated tubular support shaft 20. The upper end of the tubular support shaft 20 threadably receives a bearing support member 22 (FIG. 3) having a threaded lower portion 23 and a reduced diameter upper portion 24. Concentrically arranged about the tubular support shaft 20 is an ornamental tubular sleeve 26 which is received, at one end, in lower endcap 16 and, at its other end, in upper endcap 27. As best shown in FIG. 2, upper endcap 27 fits snuggly onto lower portion 23 of bearing support 22.

The manner in which the ornaments are supported for movement on the carousel assembly shall now be described with reference to FIGS. 2 and 3. Snugly received on bearing support 22 is a bearing assembly 30. Bearing assembly 30 includes an inner sleeve member 32 which extends between reduced diameter upper portion 24 of bearing support 22 and upper end cap 27, as best shown in FIG. 2. Bearing assembly 30 includes an outer rotary bearing member 33 which rotates with minimal friction relative to inner sleeve member 32 due to a plurality of balls 34 therebetween. As clearly shown in FIGS. 1 and 2, the ornaments 3 are supported by a ceiling plate 40. Ceiling plate 40 includes a cavity 42 on its lower side thereof which snugly receives outer rotary bearing member 33 of bearing assembly 30. Due to this arrangement, ceiling plate 40 is permitted to rotate relative to base stand 4 and the upright support assembly 15 with minimal friction.

Figure 2:
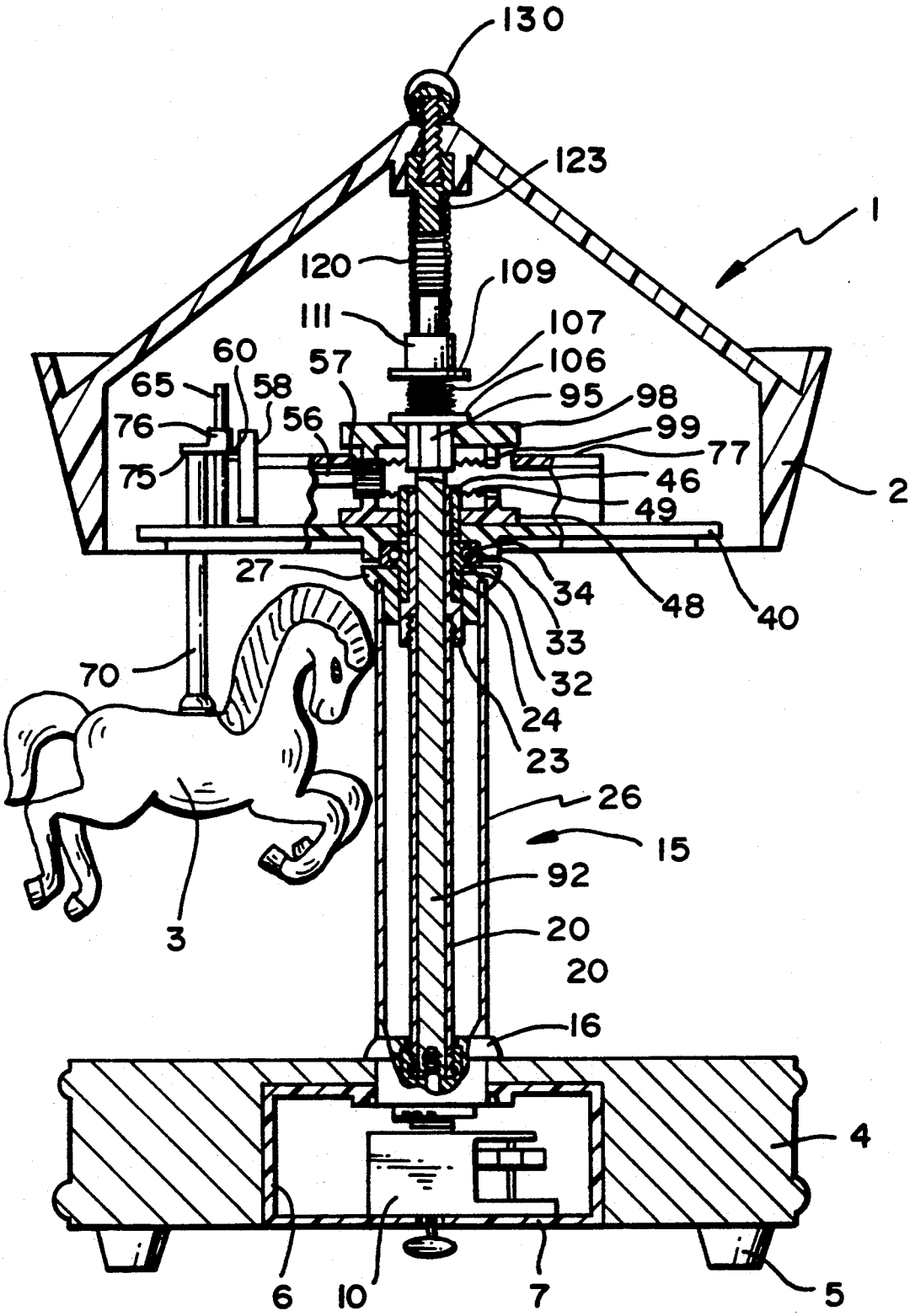
FIG. 2 is a vertical cross-sectional view of the carousel assembly shown in FIG. 1 in its assembled state.
Figure 3:
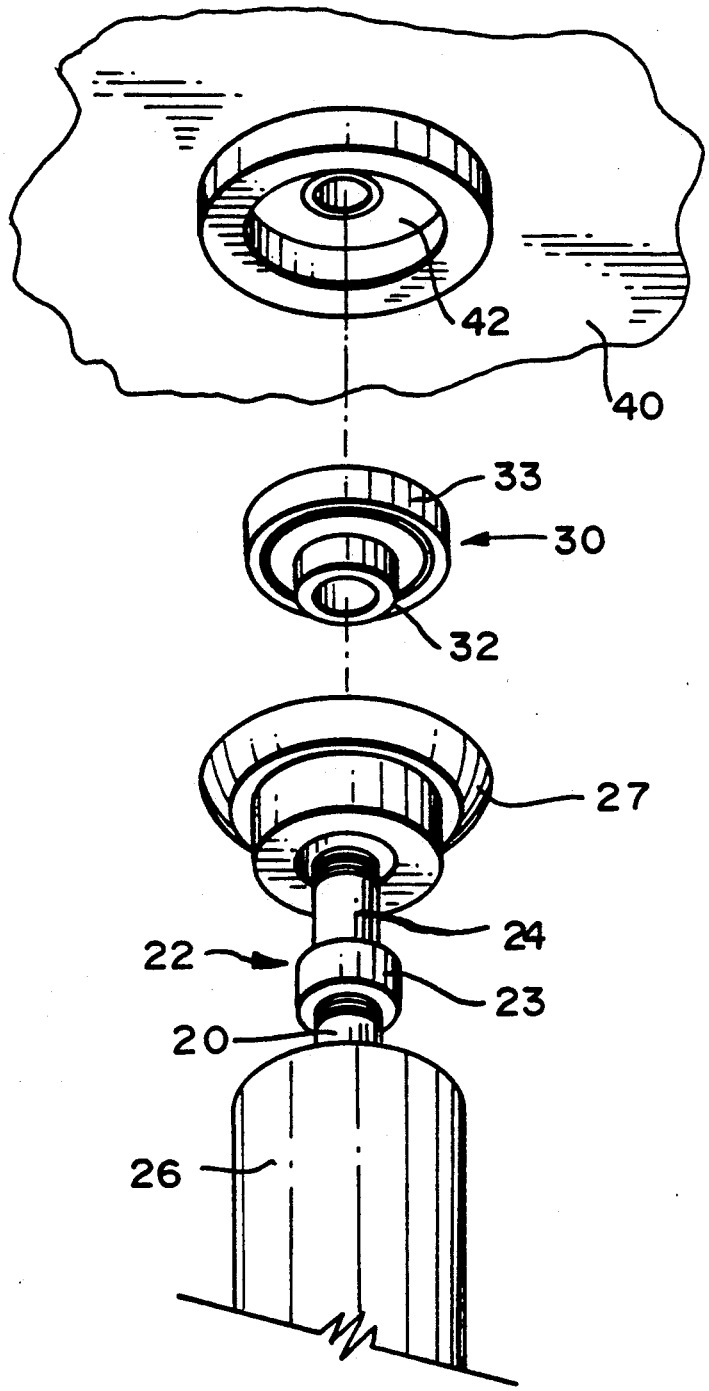
FIG. 3 is an exploded perspective view showing the interconnection of the rotational support elements for the carousel assembly shown in FIGS. 1 and 2.

Reference will now be made particularly to FIGS. 1 and 2 in describing the manner in which the drive is transmitted from the miniature music box 10 to the moving elements of the ornamental carousel assembly 1. A nut sleeve 46 is functionally secured on the top of the reduced diameter upper portion 24 of bearing support 22. Non-rotatably attached to nut sleeve 46 is a first circular gear rack 48 having a circular array of gear teeth 49 which extends uppwardly about a circumferential surface thereof. As best shown in FIG. 1, ceiling plate 40 includes an inner upstanding circular wall portion 51 and an outer upstanding circular wall portion 52. At predetermined locations about the inner and outer upstanding circular wall portions 51, 52 are formed aligned, circumferentially spaced grooves 54. Located within each pair of aligned spaced grooves 54 is a rotary driven shaft 56. Each driven shaft 56 is fixed at one end thereof to a pinion gear 57 and at the other end thereof to a driven disk 58. As best shown in FIG. 2, each driven disk includes an outwardly projecting stub shaft 60 extending substantially parallel to rotary driven shaft 56 but eccentrically offset from the drive axis thereof.

Each of these rotary driven shafts 56 are driven in a manner which will be explained more fully below and function to rotate the ceiling plate 40 while simultaneously reciprocating the various ornaments 3. Before continuing with the description of the drive from the miniature music box 10 to the ceiling plate 40 and ornaments 3, the manner in which the ornaments 3 are supported and driven for reciprocating movement and the manner in which the rotary driven shafts 56 are secured, both vertically and axially, within circumferentially spaced grooves 54 will now be described.

Evenly spaced about each pair of aligned circumferentially spaced grooves 54 is a pair of upstanding guide rails 65. Each ornament 3 is mounted to an elongated support rod 70 which extends through an aperture (not shown) in ceiling plate 40 and is fixedly secured to one apex of a triangular shaped follower plate 75. At the other two apexes of the triangular shaped follow plate 75 are formed integral guide sleeve portions 76 which slidably secure upstanding guide rails 65 there through. The underside of each triangular shaped follower plate 75 is engaged by a corresponding outwardly projecting stub shaft 60 of a driven disk 58. From viewing FIG. 2, it can be readily seen that due to the parallel but offset axis of the rotary driven shaft 56 and outwardly projecting stub shaft 60, rotation of rotary driven shaft 56 will result in vertical reciprocation of ornament 3 along guide rails 65. Also note from FIG. 2 that, due to the triangular configuration of the follower plate 75, the elongated support rod 70 is offset from upstanding guide rails 65 and outwardly projecting stub shaft 60 so as not to hinder the drive transfer.

Referring back to FIG. 1, secured to ceiling plate 40 by connection means (not shown) which may extend through mounting holes 79 is a cover plate 77 which rests on outer upstanding circular wall portion 52. Cover plate 77 also includes a plurality of tabs 78 extending inwardly therefrom which rest on top of inner upstanding circular wall portion 51. Each of the tabs 78 is located above a respective rotary driven shaft 56 such that, by the mounting of cover plate 77, the vertical and horizontal movements of rotary driven shafts 56 are restricted and pinion gears 57 remain in contact with the gear teeth 49 of first circular gear rack 48. At this time, it should be noted that although in the preferred embodiment three ornamental horses are depicted, any number and type of ornaments can be supported and driven in the manner described above.

Miniature music box 10 is of convention design and is known in the art as having an external handle which may be used to wind a spring in order to rotate a flywheel to drive an output shaft which, in turn, also drives a shaft of a music generating assembly. Since such miniature wind-up music boxes are known in the art, each particular component of music box 10 will not be fully described herein.

Continuing with the description of the manner in which drive power is transmitted to pinion gears 57 of rotary drive shafts 56, miniature music box 10 includes an output shaft 80 having secured thereto a ring 82. Formed integral with ring 82 are various resilient drive arms 83, each ending in an upwardly projecting drive tooth which engage with teeth 90 of a ratchet cog 91. The use of the ratchet mechanism enables winding of the music box 10 without rotation of the ratchet cog 91. Secured to ratchet cog 91 is a drive transmitting rod 92 which extends through upright support assembly 15, ceiling plate 40 and first circular gear rack 48, as clearly shown in FIG. 2. Secured to the upper end of drive transmitting rod 92 is a drive nut 95. Drive nut 95 has mounted thereon for rotation therewith a second circular gear rack 98 having downwardly extending gear teeth 99. As best shown in FIG. 2, gear teeth 99 engage with the gear teeth of pinion gears 57 such that pinion gears 57 are sandwiched between first and second circular gear racks 48 and 98. Since drive transmitting rod 92 is directly driven by output shaft 80 through the ratchet mechanism and second circular gear rack 98 rotates in unison with the drive transmitting rod 92, it should be evident that drive from output shaft 80 is transmitted through drive transmitting rod 92 and second circular gear rack 98 to pinion gears 57 and rotary driven shafts 56. Since pinion gears 57 are driven around the circumference of fixed first circular gear rack 48, rotation of second circular gear rack 98 results in rotation of ceiling plate 40. Since ornaments 3 are attached to ceiling plate 40, these elements rotate as well. Furthermore, since movement of pinion gears 57 results in rotation of rotary driven shaft 56, driven disk 58 and outwardly projecting stub shaft 60, rotation of second circular gear rack 98 also results in vertical reciprocating movement of ornaments 3 along upstanding guide rails 65.

Secured to or integrally formed with drive nut 95 is an upwardly arranged drive rod extension 101. About drive rod extension 101 is sequentially arranged a first washer 106, a biasing spring 107, a second washer 109 and a first threaded cap 111. Each of these elements are diametrically arranged such that washer 106 abuts against an upper surface of drive nut 95 and washer 109 abuts against first threaded cap 111 with biasing spring 107 retained therebetween. When assembled, the lower portion of washer 106 abuts an upper portion of second circular gear rack 98 and, due to the presence of biasing spring 107, biases second circular gear rack 98 downwardly into engagement with pinion gears 57. The presence of biasing spring 107 also aids in the distribution of torque from second circular gear rack 98 to pinion gears 57 by enabling second circular gear rack 98 to flex during drive transmission.

First threaded cap portion 111 includes a first larger diameter portion 112 which is secured to drive rod extension 101 in the manner discussed above and a second reduced diameter portion 113 (see FIG. 1). Onto second reduced diameter portion 113 is frictionally fit a drive and safety spring 120. A second threaded cap 123 also includes a first larger diameter portion 124 and a second reduced diameter portion 125. Second diameter portion 125 is also frictionally fit within spring 120. First diameter portion 124 of second threaded cap 123 supportably mounts canopy 2 which is secured to second threaded cap 123 by means of an ornamental threaded top bolt 130. Due to the frictional fit between spring 120 and the reduced diameter portions of first threaded cap 111 and second threaded cap 123, spring 120 rotates in unison with drive transmitting rod 92. Therefore, spring 120 not only enables canopy 2 to be rotated in unison with ceiling plate 40 and ornaments 3 but also provides a resilient connection of the canopy to the drive transmitting rod 92. This feature is extremely important especially when heavy canopies are utilized, such as those made from ceramic. Not only will such heavy canopies tend to oscillate during rotation to a certain degree due to imperfect symmetry which can be taken up by spring 120 instead of being transmitted downward through the drive assembly, but the spring also permits the canopy to flex and prevents damage during handling and in transit.

Based on the above description, it can be readily seen that due to the presence of bearing assembly 30, the ceiling plate 40, the ornaments can be driven by the miniature wind-up music box 10 since minimal frictional resistance exists. Also, due to the assembly arrangement, the presence of the bearing assembly 30 minimizing the overall height of carousel assembly 1, which is highly desirable. The particular drive system of the present invention also provides for a reliable and easily assembled drive transmission arrangement. Furthermore, the inclusion of spring 120 serves not only as a safety feature but also is an integral part of the carousel's drive and support assembly.

It is to be understood that the forms of the invention herein shown and described are to be taken as a preferred embodiment thereof and various changes in shape, material, size and arrangement of parts may be resorted to without departing from the spirit of the invention or scope of the following claims.

We claim:

1. An ornamental carousel assembly of the type wherein a plurality of ornaments are mounted on a rotating ceiling plate comprising:

(a) a base;

(b) a wind-up type drive and music box mechanism secured to said base and including an output shaft;

(c) a tubular support assembly extending upright from and supported by said base;

(d) bearing means having an inner sleeve member non-rotatably secured to an upper portion of said tubular support assembly and an outer rotary bearing member;

(e) a ceiling plate attached to said outer rotary bearing member, said ceiling plate having means to support a plurality of ornaments;

(f) drive transmitting means interconnected between said output shaft and said ceiling plate for rotating said ceiling plate on said bearing means relative to said tubular support assembly.

2. The ornamental carousel assembly of claim 1 wherein said ceiling plate includes a cavity on the lower side thereof which snugly receives said outer rotary bearing member.

3. The ornamental carousel assembly of claim 1 further including a canopy and means for drivingly connecting the canopy to said drive transmitting means for rotation therewith.

4. The ornamental carousel assembly of claim 3 wherein said means for drivingly connecting the canopy to said drive transmitting means includes a spring.

5. The ornamental carousel assembly of claim 1 wherein said plurality of ornaments are mounted for both reciprocating and rotary movement and said drive transmission means includes:

a) a drive transmitting rod drivingly connected to said drive output shaft and extending upwardly through said tubular support assembly and said ceiling plate; and b) a drive transfer means including means drivingly engaged with said drive transmiting rod for imparting a reciprocating movement to said plurality of ornaments and rotary movement to said ceiling plate.

6. The ornamental carousel assembly of claim 5 wherein said drive transfer means comprises a gear drive assembly.

7. The ornamental carousel assembly of claim 6 wherein said gear drive assembly comprises:

a) a first circular gear rack carried by said ceiling plate and fixed to said tubular support assembly, a plurality of driven shafts rotatably supported on said ceiling plate, each of said driven shafts including a pinion gear fixed at one end thereof in engagement with said first rack; and b) a second circular rack also engaged with said pinions and located above said first circular rack, said second circular rack being drivingly connected to said drive transmitting rod such that rotation of said transmitting rod by said output shaft causes rotation of said second circular rack, said driven shafts and said ceiling plate.

8. The ornamental carousel assembly of claim 7 further including a biasing spring located about a portion of said drive transmitting rod for biasing said second circular rack into engagement with said pinions.

9. The ornamental carousel assembly of claim 7 wherein each of said driven shafts has secured thereto a disk on an end opposite said pinion gear, each of said disks including an outwardly projection stub shaft eccentrically offset from the axis of its respective driven shaft, said stub shafts engaging with a respective one of said means for mounting the plurality or ornaments such that rotation of said disk by driven shaft results in a reciprocating movement of said ornaments.

10. The ornamental carousel assembly of claim 9 wherein each of said means for mounting an ornament includes a follower plate having a pair of guide sleeve portions and an elongated ornament support rod, said guide sleeve portions being received about a pair of upstanding guide rails attached to said ceiling plate and said support rod includes means for securing an ornament thereto.

11. The ornamental carousel assembly of claim 10 wherein said follower plate is triangular in shape with said guide sleeve portions being located at two apexes of the triangle and said support rod being secured at the third apex.

12. An ornamental carousel assembly of the type having a plurality of rotatable ornaments and a rotatable canopy comprising:

(a) a base;

(b) a wind-up type drive and music box mechanism secured to said base and including an output shaft;

(c) a tubular support assembly extending upright from and supported by said base;

(d) a ceiling plate rotatably supported on said tubular support assembly, said ceiling plate supporting said plurality of ornaments;

(e) drive transmitting means interconnected between said output shaft and said ceiling plate for rotating said ceiling plate;

(f) a spring mounted for rotation with said drive transmitting means, said spring supporting said canopy for rotation therewith.

13. The ornamental carousel assembly of claim 12 wherein said ceiling plate is rotatably supported on said tubular support assembly by a bearing means having an inner sleeve member non-rotatably secured to an upper portion of said tubular support assembly and an outer rotary member rotatable with said ceiling plate.

14. The ornamental carousel assembly of claim 13 wherein said ceiling plate includes a cavity on the lower side thereof for receiving said outer rotary bearing member.

15. The ornamental carousel assembly of claim 12 wherein said plurality of ornaments are mounted for both a reciprocating and rotary movement and said drive transmission means includes:

a) a drive transmitting rod drivingly connected to said drive output shaft and extending upwardly through said tubular support assembly and said ceiling plate; an b) a drive transfer means including means drivingly engaged with said drive transmiting rod for imparting a reciprocating movement to said plurality of ornaments and rotary movement to said ceiling plate.

16. The ornamental carousel assembly of claim 15 wherein said drive transfer means comprises a gear drive assembly.

17. The ornamental carousel assembly of claim 15 wherein said gear drive assembly comprises:

a) a first circular gear rack carried by said ceiling plate and fixed to said tubular support assembly, a plurality of driven shafts rotatably supported on said ceiling plate, each of said driven shafts including a pinion gear fixed at one end thereof in engagement with said first rack; and b) a second circular rack also engaged with said pinions and located above said first circular rack, said second circular rack being drivingly connected to said drive transmitting rod such that rotation of said transmitting rod by said output shaft causes rotation of said second circular rack, said driven shafts and said ceiling plate.

18. The ornamental carousel assembly of claim 17 further including a biasing spring located about a portion of said drive transmitting rod for biasing said second circular rack into engagement with said pinions.

19. The ornamental carousel assembly of claim 17 wherein each of said driven shafts has secured thereto a disk on an end opposite said pinion gear, each of said disks including an outwardly projection stub shaft eccentrically offset from the axis of its respective driven shaft, said stub shafts engaging with a respective one of said means for mounting the plurality or ornaments such that rotation of said disk by said driven shaft results in a reciprocating movement of said ornaments.

20. The ornamental carousel assembly of claim 19 wherein each of said means for mounting an ornament includes a follower plate having a pair of guide sleeve portions and an elongated ornament support rod, said guide sleeve portions being received about a pair of upstanding guide rails attached to said ceiling plate and said support rod includes means for securing an ornament thereto.

21. The ornamental carousel assembly of claim 20 wherein said follower plate is triangular in shape with said guide sleeve portions being located at two apexes of the triangle and said support rod being secured at the third apex.

* * * * *